US006384337B1

(12) United States Patent
Drum

(10) Patent No.: US 6,384,337 B1
(45) Date of Patent: May 7, 2002

(54) SHIELDED COAXIAL CABLE AND METHOD OF MAKING SAME

(75) Inventor: Michael K. Drum, Taylorsville, NC (US)

(73) Assignee: CommScope Properties, LLC, Sparks, NV (US)

( * ) Notice: Subject to any disclaimer, the term of this patent is extended or adjusted under 35 U.S.C. 154(b) by 0 days.

(21) Appl. No.: 09/603,818

(22) Filed: Jun. 23, 2000

(51) Int. Cl.[7] ..... H01B 7/34
(52) U.S. Cl. ..... 174/102 R
(58) Field of Search ..... 174/36, 102 R, 174/106 R, 105 R, 108, 109

(56) References Cited

U.S. PATENT DOCUMENTS

| | | | |
|---|---|---|---|
| RE17,850 | E | 10/1930 | Hoeftmann |
| 2,018,477 | A | 10/1935 | Wentz |
| 2,337,556 | A | 12/1943 | Hosking |
| 2,446,387 | A | 8/1948 | Peterson |
| 2,479,924 | A | 8/1949 | Gillis |
| 2,662,931 | A | 12/1953 | Mougey |
| 2,924,141 | A | 2/1960 | Kinniburgh |
| 3,051,771 | A | 8/1962 | Lee |
| 3,060,261 | A | 10/1962 | Stanley et al. |
| 3,088,995 | A | 5/1963 | Baldwin |
| 3,193,712 | A | 7/1965 | Harris |
| 3,233,036 | A | 2/1966 | Jachimowicz |
| 3,259,684 | A | 7/1966 | Wakefield |
| 3,321,572 | A | 5/1967 | Garner |
| 3,340,353 | A | 9/1967 | Mildner |
| 3,351,706 | A | 11/1967 | Gnerre et al. |
| 3,439,111 | A | 4/1969 | Miracle et al. |
| 3,459,877 | A | 8/1969 | Bullock et al. |
| 3,484,532 | A | 12/1969 | Anderson |
| 3,507,978 | A | 4/1970 | Jachimowicz |
| 3,588,317 | A | 6/1971 | Hutchins, Jr. et al. |
| 3,590,141 | A | 6/1971 | Mildner |

(List continued on next page.)

FOREIGN PATENT DOCUMENTS

| | | |
|---|---|---|
| CA | 604614 | 9/1960 |
| DE | 1540587 | 1/1970 |
| DE | 2116364 | 10/1972 |
| DE | 2915740 | 11/1980 |
| DE | 3141636 A1 | 5/1983 |
| DE | 3347196 A1 | 4/1985 |
| DE | 3615281 A1 | 11/1987 |
| DE | 3931741 A1 | 3/1990 |

(List continued on next page.)

*Primary Examiner*—Ghau N. Nguyen
(74) *Attorney, Agent, or Firm*—Alston & Bird LLP

(57) ABSTRACT

The present invention is a low cost coaxial drop cable having excellent flexibility and shielding coverage. The shielded coaxial cable of the invention includes an elongate center conductor, a dielectric layer surrounding the center conductor, an electrically conductive shield surrounding the dielectric layer, a first plurality of elongate wires surrounding the electrically conductive shield, and a protective jacket surrounding the plurality of elongate wires. The elongate wires have an elliptical cross section with a major axis to minor axis ratio of from greater than 1:1 to less than 5:1. The present invention further includes a method of making the coaxial cable of the invention.

24 Claims, 4 Drawing Sheets

U.S. PATENT DOCUMENTS 3,624,267 A 11/1971 Plummer
3,643,007 A 2/1972 Roberts et al.
3,662,090 A 5/1972 Grey
3,681,514 A * 8/1972 Rhoades et al. ..... 174/108
3,773,965 A 11/1973 Reynolds
3,780,206 A 12/1973 Reynolds
3,790,697 A 2/1974 Buckingham
3,927,247 A 12/1975 Timmons
3,971,871 A 7/1976 Haynes et al.
4,092,452 A 5/1978 Hori et al.
4,117,260 A 9/1978 Wilkenloh
4,125,739 A 11/1978 Bow
4,131,759 A 12/1978 Felkel
RE30,228 E 3/1980 Silver et al.
4,297,552 A 10/1981 Jesse et al.
4,323,721 A 4/1982 Kincaid et al.
4,327,246 A 4/1982 Kincaid
4,374,299 A 2/1983 Kincaid
4,376,920 A 3/1983 Smith
4,378,462 A 3/1983 Arnold, Jr. et al.
RE31,277 E 6/1983 Gabriel et al.
4,406,914 A 9/1983 Kincaid
4,408,089 A 10/1983 Nixon
4,439,633 A 3/1984 Grooten
4,477,693 A 10/1984 Krabec et al.
4,487,996 A 12/1984 Rabinowitz et al.
4,510,346 A 4/1985 Bursh, Jr. et al.
4,513,170 A 4/1985 Apodaca
4,563,540 A 1/1986 Bohannon, Jr. et al.
4,569,704 A 2/1986 Bohannon, Jr. et al.
4,595,431 A 6/1986 Bohannon, Jr. et al.
4,626,810 A 12/1986 Nixon
4,638,114 A 1/1987 Mori
4,641,110 A 2/1987 Smith
4,678,865 A 7/1987 Sherwin
4,691,081 A 9/1987 Gupta et al.
4,694,122 A 9/1987 Visser
4,698,028 A 10/1987 Caro et al.
4,701,575 A 10/1987 Gupta et al.
4,746,767 A 5/1988 Gruhn
4,816,614 A 3/1989 Baigrie et al.
4,871,883 A 10/1989 Guiol
4,912,283 A 3/1990 O'Connor
4,965,412 A 10/1990 Lai et al.
4,970,352 A 11/1990 Satoh
4,987,394 A 1/1991 Harman et al.
5,006,670 A 4/1991 Plant
5,061,823 A 10/1991 Carroll
5,095,176 A 3/1992 Harbrecht et al.
5,107,076 A 4/1992 Bullock et al.
5,118,905 A 6/1992 Harada
5,132,491 A 7/1992 Mulrooney et al.
5,133,034 A 7/1992 Arroyo et al.
5,170,010 A 12/1992 Aldissi
5,210,377 A 5/1993 Kennedy et al.
5,216,202 A 6/1993 Yoshida et al.
5,216,204 A 6/1993 Dudek et al.
5,218,167 A 6/1993 Gasque et al.
5,237,635 A 8/1993 Lai
5,249,248 A 9/1993 Arroyo et al.
5,254,188 A 10/1993 Blew
5,262,592 A 11/1993 Aldissi
5,274,712 A 12/1993 Lindsay et al.
5,293,001 A 3/1994 Gebs
5,321,202 A 6/1994 Hillburn
5,329,064 A 7/1994 Tash et al.
5,367,123 A 11/1994 Plummer, III et al.
5,389,736 A 2/1995 Ziemek et al.
5,414,213 A 5/1995 Hillburn
5,434,354 A 7/1995 Baker et al.
5,457,287 A 10/1995 Shimozawa et al.
5,473,113 A 12/1995 Aldissi
5,475,185 A 12/1995 Tokarsky
5,481,635 A 1/1996 Arroyo et al.
5,521,331 A 5/1996 Hillburn
5,656,796 A 8/1997 Marinos et al.
5,796,042 A 8/1998 Pope
5,959,245 A * 9/1999 Moe et al. ..... 174/36

FOREIGN PATENT DOCUMENTS

DE 19620024 A1 11/1997
EP 504776 9/1992
FR 2219498 10/1974
FR 2514189 10/1981
GB 1375677 11/1974
GB 1393432 5/1975
GB 1421796 1/1976
GB 2037060 A 7/1980
GB 2106306 4/1983
JP 52-106483 9/1977
JP 58-204417 11/1983
JP 58-22507 12/1983
JP 61-47017 3/1986
JP 61-71915 5/1986
JP 61-120119 7/1986
JP 61-211910 9/1986
JP 63-56520 4/1988
JP 63-187227 11/1988
JP 4-127918 11/1992

* cited by examiner

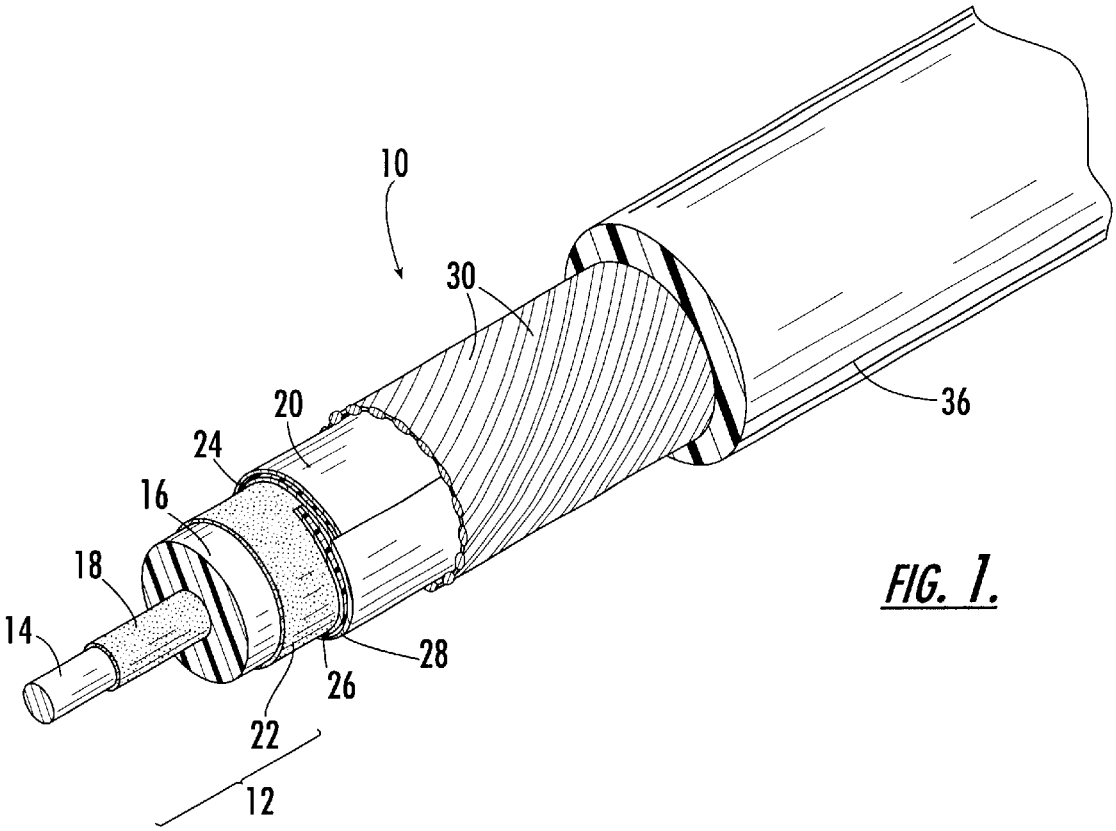
FIG. 1.
FIG. 2.
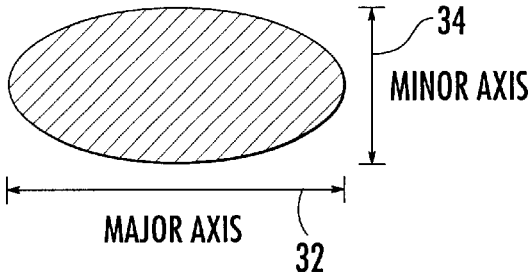

SHIELDED COAXIAL CABLE AND METHOD OF MAKING SAME

FIELD OF THE INVENTION

The invention relates to a shielded cable and more particularly, to a shielded drop cable for the transmission of RF signals.

BACKGROUND OF THE INVENTION

In the transmission of RF signals such as cable television signals, cellular telephone signals, and data, a drop cable is generally used as the final link in bringing the signals from a trunk and distribution cable directly into a subscriber's home. Conventional drop cables include an insulated center conductor that carries the signal and a conductive shield surrounding the center conductor to prevent signal leakage and interference from outside signals. In addition, the drop cable generally includes a protective outer jacket to prevent moisture from entering the cable. One common construction for drop cable includes an insulated center conductor, a laminated tape formed of metal and polymer layers surrounding the center conductor, a layer of braided metallic wires, and an outer protective jacket.

It has been found during the manufacture of conventional drop cables, that the relatively small diameter round wires forming a typical braided covering will easily break unless the braiding is done at a relatively slow speed. For example, the braiding operation may typically be performed at a rate of only about 10 to 11 linear feet per minute. In contrast, the final step of applying the protective plastic jacket can be performed at speeds as high as 450 linear feet per minute. Moreover, proper extrusion of the plastic jacket requires a higher linear speed than 10 to 11 feet per minute. Thus, two discrete process steps are required to form the braid and then apply the outer protective plastic jacket in a conventional drop cable manufacturing process.

In addition to process concerns, the cost of the raw material for making a coaxial drop cable is often an important factor in the cable design. For a cable television company having thousands of miles of drop cable, the cost savings of a minor reduction in the amount of material in the drop cable becomes significant. Unfortunately, it is not possible to reduce the amount of metal in the round reinforcing wire covering of the prior art drop cable without compromising the strength of the cable or without further reducing the speed of the braiding step.

The shielding of the center conductor is another important aspect of the cable design. It is generally desirable to increase the percentage of coverage that the reinforcing layer provides to the electrically conductive foil shield to thereby reduce leakage of the high frequency of signals from the cable. In a conventional round wire reinforcing covering, an increase in the desired coverage would require a greater quantity of metal and, therefore, add to the overall expense of the cable.

One approach to reducing the cost of a drop cable while providing the desired flexibility and shielding is described in U.S. Pat. No. 5,254,188 to Blew. Blew uses a coaxial cable wherein the outer conductor includes a plurality of flat reinforcing wires wrapped around a foil shield to form an electrically conductive reinforcing covering. Although Blew's approach provides a coaxial drop cable with certain advantages, there is a desire in the art to further increase the flexibility and cost in the production of coaxial cables while maintaining the desired amount of shielding coverage.

SUMMARY OF THE INVENTION

The present invention provides a low cost, shielded coaxial drop cable having excellent flexibility and shielding coverage. The shielded coaxial cable of the invention comprises an elongate center conductor, a dielectric layer surrounding the center conductor, an electrically conductive shield surrounding the dielectric layer, a first plurality of elongate wires surrounding the electrically conductive shield, and a protective jacket surrounding the plurality of elongate wires. In accordance with the invention, the elongate wires have an elliptical cross section with a major axis and a minor axis wherein the major axis to minor axis ratio is from greater than 1:1 to less than 5:1.

The coaxial cables of the invention produce excellent shielding but use less material than conventional cables that use elongate wires having a circular cross section. Thus, the present cables are less expensive to produce than conventional cables. The elongate strands used in the invention also have good tensile strength and are not subject to breakage even at high production speeds (e.g. 200 ft/min or more). Furthermore, the elongate wires because of their elliptical cross section are freely displaceable axially and capable of slipping over or under one another. As a result, the cables of the invention have excellent flexibility. In addition, the wires can be easily processed using conventional machinery. Moreover, the elongate wires of the invention can be readily formed into braids. The cables of the invention can also be easily connectorized using standard connectors.

In a preferred embodiment of the invention, the elongate wires have a major axis to minor axis ratio of from 1.5:1 to 3:1, more preferably of about 2:1. The first plurality of elongate wires is preferably arranged such that the surfaces corresponding to the major axes of the elongate wires contact the underlying metallic shield. In addition, the elongate wires are preferably helically arranged around the underlying electrically conductive shield. The coaxial cable can also include a second plurality of elongate wires helically arranged about the first plurality of elongate wires and having a helical orientation opposite the orientation of the first plurality of elongate wires. The first plurality of elongate wires can also be interlaced with a second plurality of elongate wires to form a braid around the first electrically conductive shield. In either case, the second plurality of elongate wires preferably has an elliptical cross section with a major axis to minor axis ratio of from greater than 1:1 to less than 5:1. The first plurality and second plurality of elongate wires are preferably formed from aluminum or an aluminum alloy, or copper or a copper alloy.

Furthermore, in the preferred embodiment of the invention, the electrically conductive shield extends longitudinally along the cable and more preferably has overlapping longitudinal edges. Preferably, the electrically conductive shield comprises a bonded metal-polymer-metal laminate tape. In addition, the electrically conductive shield is preferably adhesively bonded to the dielectric layer and the dielectric layer is adhesively bonded to the center conductor.

The invention further includes a method of making the shielded cables of the invention. The method includes advancing a center conductor along a predetermined path of travel, applying a dielectric layer around the center conductor, applying a electrically conductive shield around the dielectric layer, arranging a plurality of elongate wires having an elliptical cross section with a major axis to minor axis ratio of from greater than 1:1 to less than 5:1 around the electrically conductive shield, and applying a cable jacket around the plurality of elongate wires. The elongate wires preferably have a major axis to minor axis ratio of from 1.5:1 to 3:1, more preferably of about 2:1. The elongate wires are preferably helically arranged around the underlying electrically conductive shield. A second plurality of elongate wires can also be helically arranged around the first plurality of elongate wires using a helical orientation opposite the orientation of the first plurality of metal wires, or braided with the first plurality of elongate wires around the electrically conductive shield. The second plurality of elongate wires preferably has an elliptical cross section with a major axis to minor axis ratio of from greater than 1:1 to less than 5:1. The electrically conductive shield is preferably longitudinally arranged around the dielectric layer, more preferably by overlapping the longitudinal edges of the electrically conductive shield.

These and other features and advantages of the present invention will become more readily apparent to those skilled in the art upon consideration of the following detailed description and accompanying drawings, which describe both the preferred and alternative embodiments of the present invention.

BRIEF DESCRIPTION OF THE DRAWINGS

FIG. 1 is a perspective view of a shielded cable according to the invention having portions thereof partially removed for purposes of illustration.

FIG. 2 is a cross-sectional view of the elongate wires used in the shielded cables of the invention.

DETAILED DESCRIPTION OF THE PREFERRED EMBODIMENTS

Figure 3:
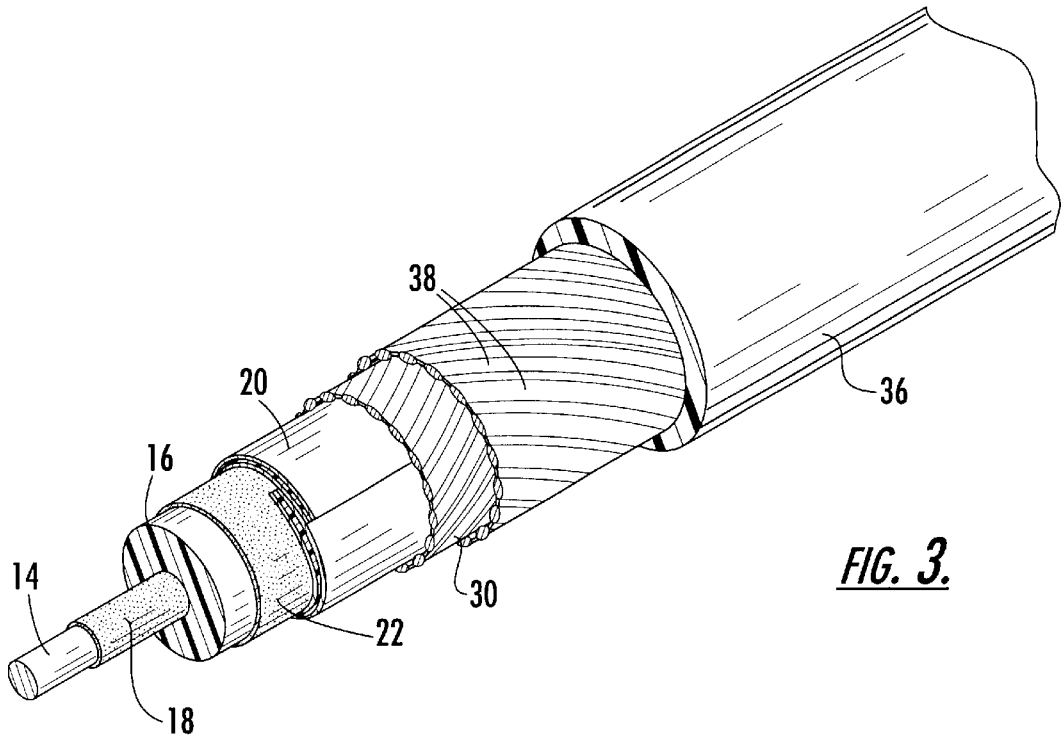
FIG. 3 is a perspective cutaway view of a shielded cable further comprising a second plurality of elongate wires in an opposite helical orientation than the first plurality of elongate wires in accordance with the invention.

In the drawings and the following detailed description, preferred embodiments are described in detail to enable practice of the invention. Although the invention is described with reference to these specific preferred embodiments, it will be understood that the invention is not limited to these preferred embodiments. But to the contrary, the invention includes numerous alternatives, modifications and equivalents as will become apparent from consideration of the following detailed description and accompanying drawings. In the drawings, like numbers refer to like elements throughout.

Referring now to FIG. 1, there is shown a shielded cable 10 in accordance with the present invention. The shielded cable 10 is generally known as drop cable and is used in the transmission of RF signals such as cable television signals, cellular telephone signals, data and the like. In particular, the drop cable of the invention can be used for 50 ohm applications. Typically, the over-the-jacket diameter of the cable 10 is between about 0.24 and 0.41 inches.

The cable 10 includes a cable core 12 comprising an elongate center conductor 14 and a dielectric layer 16 surrounding the center conductor. Preferably, the dielectric layer 16 is bonded to the center conductor 14 by an adhesive layer 18 formed, e.g., of an ethylene-acrylic acid (EAA), ethylene-vinyl acetate (EVA), or ethylene methylacrylate (EMA) copolymer or other suitable adhesive. Preferably, the adhesive layer 18 is formed of an EAA copolymer. As mentioned above, the center conductor 14 in the shielded cable 10 of the invention is generally used in the transmission of RF signals. Preferably, the center conductor 14 is formed of copper clad steel wire but other conductive wire (e.g. copper) can also be used. The dielectric layer 16 can be formed of either a foamed or a solid dielectric material. Preferably, the dielectric layer 16 is a material that reduces attenuation and maximizes signal propagation such as a foamed polyethylene. In addition, solid polyethylene can be used in place of the foamed polyethylene or can be applied around the foamed polyethylene. In any event, the dielectric layer 16 is preferably continuous from the inner conductor 14 to the adjacent overlying layer.

An electrically conductive shield 20 is applied around the dielectric layer 16. The conductive shield 20 is preferably bonded to the dielectric layer 16 by an adhesive layer 22. The adhesive layer 22 can be formed of any of the materials discussed above with respect to adhesive layer 18. The conductive shield 20 advantageously prevents leakage of the signals being transmitted by the center conductor 14 and interference from outside signals. The conductive shield 20 is preferably formed of a shielding tape that extends longitudinally along the cable. Preferably, the shielding tape is longitudinally applied such that the edges of the shielding tape are either in abutting relationship or are overlapping to provide 100% shielding coverage. More preferably, the longitudinal edges of the shielding tape are overlapped. The shielding tape includes at least one conductive layer such as a thin metallic foil layer. Preferably, the shielding tape is a bonded laminate tape including a polymer layer 24 with metal layers 26 and 28 bonded to opposite sides of the polymer layer. The polymer layer 24 is typically a polyolefin (e.g. polypropylene) or a polyester film. The metal layers 26 and 28 are typically thin aluminum foil layers. To prevent cracking of the aluminum in bending, the aluminum foil layers can be formed of an aluminum alloy having generally the same tensile and elongation properties as the polymer layer. In addition, the shielding tape preferably includes an adhesive on one surface thereof to provide the adhesive layer 22 between the first shielding tape and the dielectric layer 16. Alternatively, however, the adhesive layer 22 can be provided by other means. Preferably, the shielding tape forming the conductive shield 20 is a bonded aluminum-polypropylene-aluminum laminate tape with an EAA copolymer adhesive backing.

As shown in FIG. 1, a first plurality of elongate wires 30 surrounds the conductive shield 20. The elongate wires 30 are preferably helically arranged around the underlying conductive shield 20. As shown in FIG. 2, the elongate wires 30 have an elliptical cross-section comprising a major axis 32 and a minor axis 34. In accordance with the invention, the ratio of the major axis 32 to the minor axis 34 is from greater than 1:1 to less than 5:1, preferably from 1.5:1 to 3:1, and more preferably about 2:1. For example, the elongate wires 30 can have a major axis of 0.0063 inch and a minor axis of 0.00315 inch. The elongate wires 30 are metal and are preferably formed of aluminum or an aluminum alloy but can be formed of any suitable material such as copper or a copper alloy. Typically, the elongate wires 30 are produced by drawing wires having a circular cross-section through an elliptical die but they can be produced by other suitable means. The elongate wires 30 are preferably applied such that they lie relatively flat against the conductive shield 20. In other words, the surfaces corresponding to the major axes 24 of the elongate wires are in contact with the underlying conductive shield 20 and adjacent elongate wires contact each other along the surfaces corresponding to their minor axes 22. Although the elongate wires 30 are generally not bonded to one another, a binding agent or adhesive can be used to stabilize the elongate wires during manufacture as long as the bond is relatively weak and permits axial displacement of the strands during connectorization.

As shown in FIG. 1, a cable jacket 36 surrounds the elongate wires 30 and protects the cable from moisture and other environmental effects. The jacket 36 is preferably formed of a non-conductive material such as polyethylene or polyvinyl chloride. Alternatively, a low smoke insulation such as a fluorinated polymer can be used if the cable 10 is to be installed in air plenums requiring compliance with the requirements of UL910.

FIG. 3 illustrates an alternative embodiment of the invention. In FIG. 3, a second plurality of elongate wires 38 surrounds the first plurality of elongate wires 30. Preferably, the second plurality of elongate wires 38 is helically arranged about the first plurality of elongate wires 30 and has a helical orientation opposite the helical orientation of the first plurality of elongate wires 30. For example, the first plurality of elongate wires 30 can be applied in a clockwise orientation and the second plurality of elongate wires 38 can be applied in a counterclockwise orientation. The elongate wires 38 have an elliptical cross section with a major axis to minor axis ratio of greater than 1:1 to less than 5:1, preferably from 1.5:1 to 3:1, and more preferably about 2:1. Typically, the elongate wires 38 have the same elliptical cross-section as the elongate wires 30. The elongate wires 38 are preferably applied such that they lie relatively flat against the elongate wires 30, i.e., such that the surfaces corresponding to the major axes of the elongate wires 38 contact the elongate wires 30.

Figure 4:
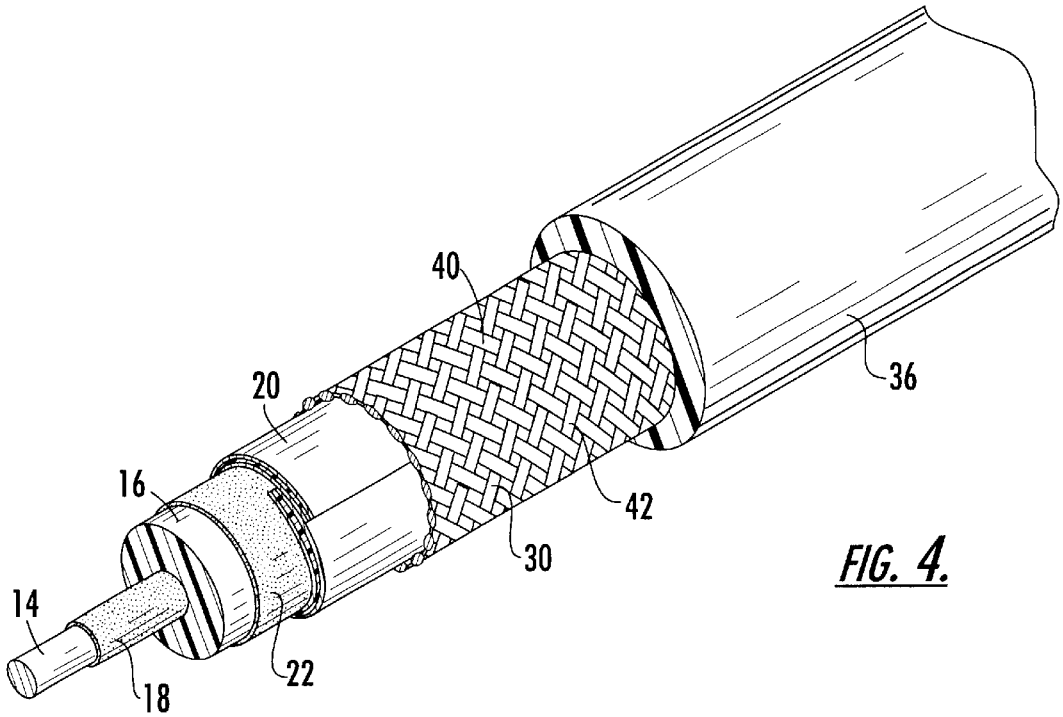
FIG. 4 is a perspective cutaway view of a shielded cable further comprising a second plurality of elongate wires braided together with the first plurality of elongate wires in accordance with the invention.

FIG. 4 illustrates another alternative embodiment of the invention. In FIG. 4, the first plurality of elongate strands 30 is interlaced with a second plurality of elongate strands 40 to form a braid 42. The elongate wires 40 have an elliptical cross section with a major axis to Minor axis ratio of greater than 1:1 to less than 5:1, preferably from 1.5:1 to 3:1, and more preferably about 2:1. Typically, the elongate wires 40 have the same elliptical cross-section as the elongate wires 30. The braid 42 is preferably formed such that the elongate wires 30 and the elongate wires 40 lie relatively flat against the conductive shield 20, i.e., such that the surfaces corresponding to the major axes of the elongate strands 30 and 40 contact the conductive shield 20. As mentioned above, because of their elliptical cross-section, the elongate wires 30 and 40 can be readily processed using conventional equipment and formed into a braid 42.

Figure 5:
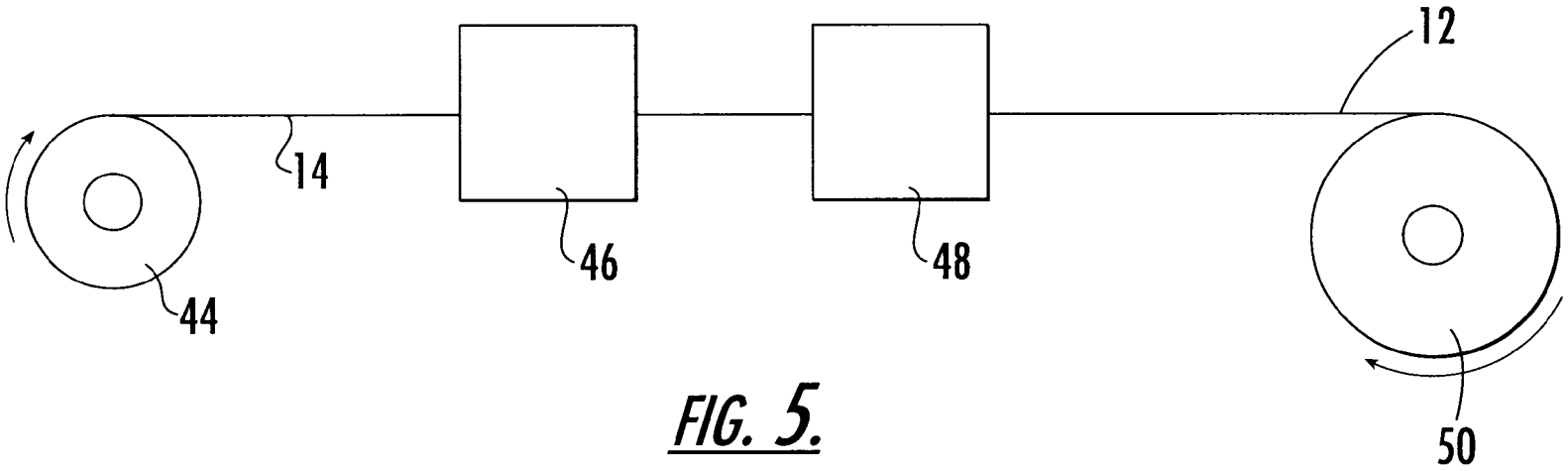
FIG. 5 is a schematic illustration of a method of making a cable core for use in the shielded cables of the present invention.
Figure 6:
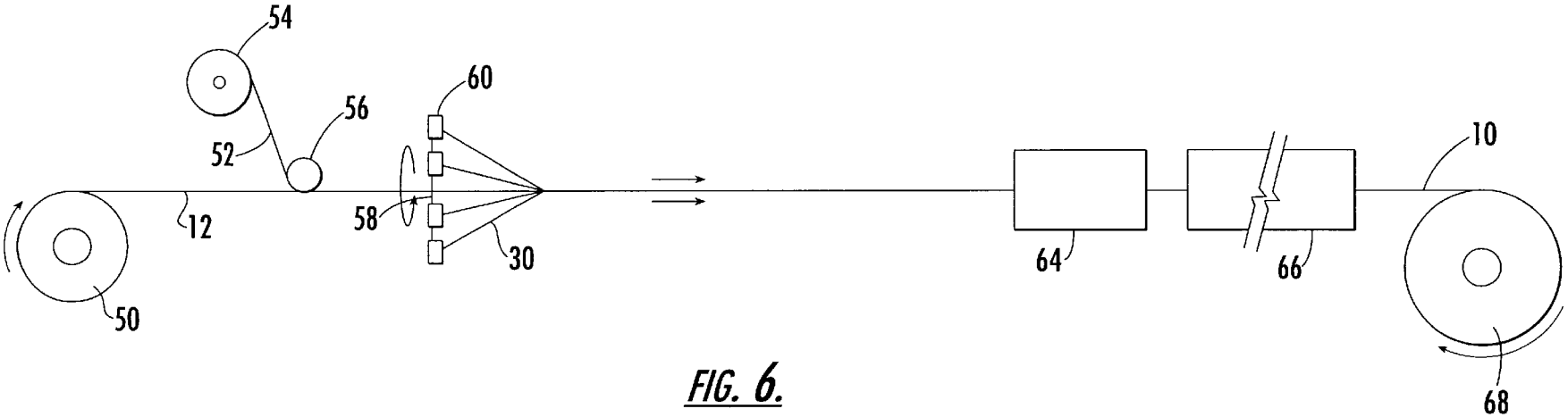
FIG. 6 is a schematic illustration of a method of making a shielded cable according to the invention.

FIGS. 5 and 6 illustrate a preferred method of making the shielded cable 10 of the invention. As shown in FIG. 5, a center conductor 14 is advanced from a reel 44 along a predetermined paths of travel (from left to right in FIG. 5). As the center conductor 14 advances, an adhesive layer 18 is applied by a suitable apparatus 46 such as an extruder apparatus. The adhesive-coated center conductor then further advances to an extruder apparatus 48 that applies a polymer melt composition to the center conductor 14, thereby activating the adhesive, layer 18. The polymer melt composition is preferably a foamable polyethylene composition. Once the coated center conductor leaves the extruder apparatus 48, the polymer melt composition expands to form the dielectric layer 16. The resulting cable core 12 can then be collected on a reel 50 or further advanced through the process.

As shown in FIG. 6, the cable core 12 comprising a center conductor 14 and surrounding dielectric layer 16 is advanced from a reel 50. As the cable core 12 is advanced, a shielding tape 52 is supplied from a reel 54 and is longitudinally wrapped or "cigarette-wrapped" around the cable core to form the electrically conductive shield 20. As mentioned above, the shielding tape 52 is preferably a bonded metal-polymer-metal laminate tape having an adhesive on one surface thereof. The shielding tape 52 is applied with the adhesive surface positioned adjacent the underlying cable core 12. If an adhesive layer is not already included on the shielding tape 52, an adhesive layer can be applied by suitable means such as extrusion prior to longitudinally wrapping the first shielding tape around the core 12. One or more guiding rolls 56 direct the shielding tape 52 around the cable core 12 with longitudinal edges of the first shielding tape preferably overlapping to provide a conductive shield 20 having 100% shielding coverage of the cable core 12.

The wrapped cable core is next advanced to a creel 58 that helically winds or "serves" the elongate wires 30 around the conductive shield 20. The creel 58 preferably includes a plurality of spools 60 for arranging the elongate wires 30 around the conductive shield 20. The creel 58 rotates in either a clockwise or counterclockwise direction to provide helical winding of the elongate wires 30. An additional creel (not shown), preferably having an orientation opposite the creel 58, can also be included to apply a second plurality of elongate wires 38 around the first plurality of elongate strands 30 to produce the cable of FIG. 3. Alternatively, to produce the cable illustrated in FIG. 4, the creel 58 can be replaced with a plurality of bobbins (not shown) or any conventional braider can be used to form a braid 42 using the first plurality of elongate strands 30 and the second plurality of elongate strands 40.

Once the elongate strands 30 have been applied, the cable is advanced to an extruder apparatus 64 and a polymer melt is extruded at an elevated temperature around the elongate strands to form the cable jacket 36. The heat from the extruded melt generally activates the adhesive layer 22 to provide a bond between the conductive shield 20 and the dielectric layer 16. Once the protective jacket 24 has been applied, the cable is quenched in a cooling trough 66 to harden the jacket and the cable is taken up on a reel 68.

In the shielded cables of the invention, the elongate wires 30 in conjunction with the conductive shield 20 produce excellent shielding of the center conductor. Moreover, the elongate wires 30 of the invention use less material than conventional cables that use wires having a circular cross-section. Thus, the present cables are less expensive to produce than cables that use elongate wires having a circular cross section. In the alternative, the same amount of material can be used that is used in conventional cables to produce a cable having greater strength using the elongate wires of the invention. Furthermore, the elongate wires 30 of the invention because of their elliptical cross section are rounded or curved and hence are freely displaceable axially and capable of slipping over or under one another. This allows the elongate wires 30 of the invention to be easily processed using conventional processing machinery. Moreover, because the elongate wires 30 are capable of being displaced, the coaxial cables of the invention have excellent flexibility and can be easily connectorized using standard connectors. The elongate wires 30 of the invention can be processed more quickly than the wires having circular cross-section that are used in conventional cables. Accordingly, the step of arranging the elongate wires can advantageously be performed in tandem with the jacket application step. To this end, the elongate wires 30 of the invention has a higher tensile strength than conventional round wires and are not as subject to breakage during processing.

It is understood that upon reading the above description of the present invention and reviewing the accompanying drawings, one skilled in the art could make changes and variations therefrom. These changes and variations are included in the spirit and scope of the following appended claims.

That which is claimed:

1. A shielded coaxial cable, comprising:

an elongate center conductor;

a dielectric layer surrounding said center conductor;

an electrically conductive shield surrounding said dielectric layer;

a first plurality of elongate wires surrounding said electrically conductive shield; said first elongate wires having an elliptical cross section with a major axis and a minor axis and a major axis to minor axis ratio of from greater than 1:1 to less than 5:1; and a protective jacket surrounding said plurality of elongate wires.

2. The shielded coaxial cable according to claim 1, wherein said first elongate wires have a major axis to minor axis ratio of from 1.5:1 to 3:1.

3. The shielded coaxial cable according to claim 1, wherein said first elongate wires have a major axis to minor axis ratio of about 2:1.

4. The shielded coaxial cable according to claim 1, wherein said first plurality of elongate wires are arranged such that the surfaces corresponding to the major axes of the elongate wires contact the underlying shield.

5. The shielded coaxial cable according to claim 1, wherein the first elongate wires are helically arranged around the underlying electrically conductive shield.

6. The shielded coaxial cable according to claim 5, further comprising a second plurality of elongate wires helically arranged about the first plurality of elongate wires and having a helical orientation opposite the orientation of the first plurality of elongate wires.

7. The shielded coaxial cable according to claim 6, wherein the wires in said second plurality of elongate wires have an elliptical cross section with a major axis to minor axis ratio of from greater than 1:1 to less than 5:1.

8. The shielded coaxial cable according to claim 1, further comprising a second plurality of elongate wires, said first plurality of elongate wires and said second plurality of elongate wires arranged together to form a braid around said electrically conductive shield.

9. The shielded coaxial cable according to claim 8, wherein the wires in said second plurality of elongate wires have an elliptical cross section with a major axis to minor axis ratio of from greater than 1:1 to less than 5:1.

10. The shielded coaxial cable according to claim 1, wherein the first elongate wires are formed from aluminum or an aluminum alloy.

11. The shielded coaxial cable according to claim 1, wherein the electrically conductive shield extends longitudinally along the cable.

12. The shielded coaxial cable according to claim 11, wherein the electrically conductive shield has overlapping longitudinal edges.

13. The shielded coaxial cable according to claim 1, wherein the electrically conductive shield comprises a bonded metal-polymer-metal laminate tape.

14. The shielded coaxial cable according to claim 1, wherein the electrically conductive shield is adhesively bonded to the dielectric layer.

15. The shielded coaxial cable according to claim 1, wherein the dielectric layer is adhesively bonded to the center conductor.

16. A shielded coaxial cable, comprising:

an elongate center conductor;

a dielectric layer surrounding said center conductor and bonded thereto;

a bonded metal-polymer-metal laminate tape extending longitudinally along the cable and having overlapping longitudinal edges, said laminate tape surrounding said dielectric layer and bonded thereto;

a plurality of elongate wires helically arranged around said electrically conductive shield; said elongate wires having an elliptical cross section with a major axis an a minor axis such that the major axis to minor axis ratio is from 1.5:1 to 3:1 and arranged such that the surfaces corresponding to the major axes of the elongate wires contact the underlying laminate tape; and a protective jacket surrounding said plurality of elongate wires.

17. A method of making a shielded cable comprising the steps of:

advancing a center conductor along a predetermined path of travel;

applying a dielectric layer around the center conductor;

applying an electrically conductive shield around the dielectric layer;

arranging a plurality of elongate wires around the electrically conductive shield; said elongate wires having an elliptical cross section with a major axis to minor axis ratio of from greater than 1:1 to less than 5:1 applying a cable jacket around the plurality of elongate wires.

18. The method according to claim 17, wherein said arranging step comprises arranging the plurality of elongate wires around the electrically conductive shield; said elongate wires having an elliptical cross section with a major axis to minor axis ratio of from 1.5:1 to 3:1.

19. The method according to claim 17, wherein said arranging step comprises arranging the plurality of elongate wires around the electrically conductive shield; said elongate wires having an elliptical cross section with a major axis to minor axis ratio of about 2:1.

20. The method according to claim 17, wherein said arranging step comprises arranging the elongate wires helically around the underlying electrically conductive shield.

21. The method according to claim 20, further comprising the step of arranging a second plurality of elongate wires helically around the first plurality of elongate wires using a helical orientation opposite the orientation of the first plurality of metal wires, said second plurality of elongate wires having an elliptical cross section with a major axis to minor axis ratio of from greater than 1:1 to less than 5:1.

22. The method according to claim 17, wherein said arranging step comprising braiding the first plurality of elongate wires and a second plurality of elongate wires around the electrically conductive shield, said second plurality of elongate wires having an elliptical cross section with a major axis to minor axis ratio of from greater than 1:1 to less than 5:1.

23. The method according to claim 17, wherein said step of applying the electrically conductive shield around the dielectric layer comprises longitudinally arranging the electrically conductive shield around the dielectric layer.

24. The method according to claim 23, wherein said step of applying an electrically conductive shield around the dielectric layer comprises longitudinally arranging the electrically conductive shield around the dielectric layer such that the electrically conductive shield has overlapping longitudinal edges.

* * * * *